US007578393B2

(12) United States Patent
Gillon

(10) Patent No.: US 7,578,393 B2
(45) Date of Patent: Aug. 25, 2009

(54) PACKAGING

(75) Inventor: Kevin Gillon, London (GB)

(73) Assignee: Origin Products Limited, London (GB)

( * ) Notice: Subject to any disclaimer, the term of this patent is extended or adjusted under 35 U.S.C. 154(b) by 318 days.

(21) Appl. No.: 11/108,180

(22) Filed: Apr. 18, 2005

(65) Prior Publication Data

US 2006/0021906 A1 Feb. 2, 2006

(30) Foreign Application Priority Data

Jul. 29, 2004 (GB) ..... 0416887.8

(51) Int. Cl.
*B65D 5/00* (2006.01)
*B65D 25/54* (2006.01)
*B65D 73/00* (2006.01)

(52) U.S. Cl. ..... 206/774; 206/766; 206/457

(58) Field of Classification Search ..... 206/766, 206/767, 774, 457, 232
See application file for complete search history.

(56) References Cited

U.S. PATENT DOCUMENTS 5,038,930 A * 8/1991 Holtkamp, Jr. ..... 206/232
5,232,087 A * 8/1993 Schluger ..... 206/45.29
5,497,876 A * 3/1996 Fleming ..... 206/232
6,070,719 A * 6/2000 Pollock ..... 206/232
6,527,111 B2 * 3/2003 Leung et al. ..... 206/232
6,659,271 B2 * 12/2003 Parsons ..... 206/232
2002/0153265 A1 * 10/2002 Leung et al. ..... 206/232
2002/0162757 A1 * 11/2002 Parsons ..... 206/232
2004/0055921 A1 * 3/2004 Parsons ..... 206/472
2004/0149601 A1 * 8/2004 Carty et al. ..... 206/232
2005/0087469 A1 * 4/2005 Carty et al. ..... 206/461

FOREIGN PATENT DOCUMENTS

EP 1621469 A2 * 2/2006

* cited by examiner

*Primary Examiner*—J. Gregory Pickett
(74) *Attorney, Agent, or Firm*—Woodard, Emhardt, Moriarty, McNett & Henry LLP

(57) ABSTRACT

The invention relates to the provision of package which can be used in a first condition for retail purposes such that an item or items and/or information relating to the item(s) within the package, can be viewed externally of the package, and a second condition for use as, for example, a gift, in which the item and/or information is masked from external view. In one embodiment the change between first and second conditions can be achieved by moving a flap of the packaging between first and second locations.

23 Claims, 5 Drawing Sheets

PACKAGING

Figure 1A:
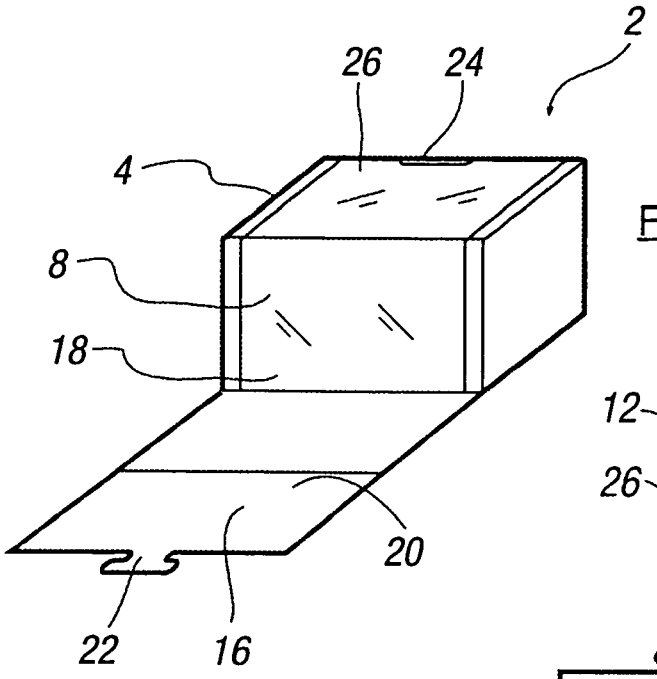

The invention which is the subject of this application relates to a form of packaging which is an improvement over conventional packaging for items such as, but not exclusively, toys.

The use of packaging for retail purposes is well known and such uses include, for example, the retailing of toys. The packaging allows the article(s) which form the toy, to be held and retained within the package. The package typically includes, on the outer surface printed information relating to the item or items therein, such as advertising, manufacturers information, pricing information and the like and, in certain instances, can include at least one aperture which can be open or covered by a clear plastics material so as to be "see-through" thereby allowing the items in the package to be viewable by potential purchasers when on display for purchase in a retail premises.

For certain items it is regarded as being important that at least some of the articles or part of an article which make up the item are available for viewing within the box as this advertises the item to potential purchasers, allows the purchasers to understand the contents of the item and, as a result, makes the product more attractive to purchasers than other products which are also available for sale.

Conventionally, once an item has been purchased, the same can be used immediately by the purchaser, in which case the items held in the package are removed and, if in the form of a toy, played with. However, frequently and alternatively, the item is purchased as a gift for another person and in this case the package is wrapped by the purchaser in an outer covering such as patterned gift paper and presented to the person as the gift. The reason for applying the paper is to, firstly, hide the contents of the gift, and therefore allow the same to be presented as a surprise to the other person, and, secondly, to provide an attractive outer appearance to the package with the user typically selecting the patterned paper which they wish to use to wrap the package.

The need for the person to purchase a package and then purchase gift paper to wrap around the package represents additional cost to the purchaser and, furthermore, requires the purchaser to take more time in having to buy and wrap the package with the patterned paper and, if the person is not particularly skilled at wrapping, the use of the patterned paper may provide an untidy appearance to the finished article. Furthermore, in these environmentally conscious times, the use of additional paper to enclose a product which is already enclosed within a package, is wasteful.

The aim of the present invention is to provide packaging in a form which allows both the display and protection of an item or items therein and also provides a means whereby the package can be adapted to take a form which has an appearance which is suitable for the same to be given as a gift without the requirement for additional wrapping.

In a first aspect of the invention, there is provided a package containing at least one item therein, said package including external walls and provided for use in a first condition in which the item and/or information relating to the item is viewable and wherein said package is movable to a second condition in which the said at least one item and/or information relating to the item is at least partially masked.

In a preferred embodiment the package includes a flap, said flap selectively movable with respect to the package to allow the condition of the package to be changed. In one embodiment the flap is movable to a position overlying at least part of the remainder of the package and in one embodiment the flap is moved from a first position when the package is in a first condition to a second position with the package in a second condition.

In one embodiment, the flap is movable about at least one fold line formed on the package so as to allow the same to be moved between the first and second conditions.

In one embodiment, the flap includes a locking portion for selective engagement with matching engagement means provided on the package so as to allow the flap to be retained with the package in the second condition.

In one embodiment, the item is viewable, with the package in the first condition, through an aperture which acts as a display portion of the package. In one embodiment the flap portion is of a size and provided with fold lines so as to be positionable, when the package is in the second condition, to mask said display portion. In addition, or instead, the package includes printed information relating to the at least one item which is viewable when the package is in the first condition and the flap portion is of a size and is positionable such that, when the package is moved to the second condition, the information is hidden from view.

In one embodiment, those walls of the package which are not masked in the second condition, are provided with an outer surface with a pattern thereon and said flap portion is also provided with a pattern on a surface thereof such that when the flap portion is moved to bring the package to a second condition, the said surface forms an outer surface of the package and the pattern applied thereto is viewable.

In a preferred embodiment, the pattern applied to the walls of the package and the pattern applied to the surface of the flap match, such that when the package is in the second condition, the outer surface of the package, as a whole, has a matching pattern. Typically the package, in the second condition has the appearance of a gift with an attractive patterned outer surface and therefore gift paper need not be used to wrap the same thereafter. At the same time, the provision of the flap means that the item within the package is not viewable and therefore the element of surprise of giving a gift is maintained.

In one embodiment the flap has printed material applied on the opposing surface to the said pattern, said printed material viewable when the package is in the first condition. In one embodiment the printed material shows information relating to the item(s) in the package.

In one embodiment, the wall(s) of the package on which the display portion is formed, has a printed display applied thereto and the purpose of that is to make the package as attractive as possible when in the first condition to a potential purchaser when the package is used at a retail point. Typically in this embodiment, the flap is folded around the package to allow the display portion to be viewed.

In one embodiment at least one item in the package is a toy and there is included a sample means which, when pressed or otherwise activated by a person, allows an action or effect of the toy to be generated as an indication to potential purchasers of what the toy will do once purchased. Typically the sample means is only exposed for use when the package is in the first condition.

In a further aspect of the invention there is provided a package containing an item therein, said package provided for use in a first condition in which the item and/or information relating to the item is viewable from externally of the package for retail purposes and wherein said package is movable to a second condition in which the said at least one item and/or information relating to the item is at least partially masked by a flap of the package which is moved from a position in which the same forms at least one double wall of the package in the first condition, to a position to form at least one double wall of the package in the second condition and mask the item and/or information from view externally of the package.

In one embodiment the item is a toy.

In a further aspect of the invention there is provided a method of forming a gift from a retail package, said method comprising the steps of purchasing an item held within a package in a first condition in which the item and/or information relating to the item is viewable on at least one face of the package and wherein the package is manipulable without removing the item from the package, into a second condition in which the item and/or printed information relating thereto is masked from external view.

Typically the manipulation includes moving a part of the package from a first position to a second position.

Figure 4A:
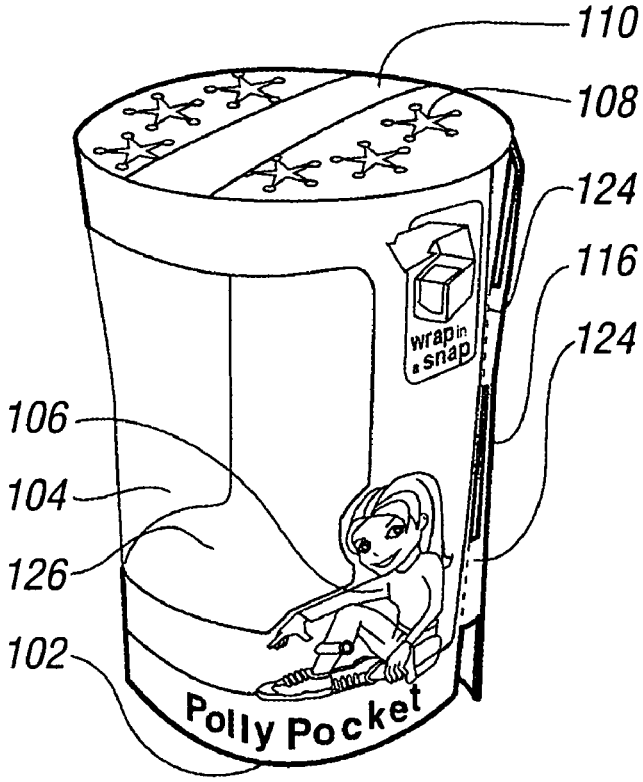
Figure 5A:
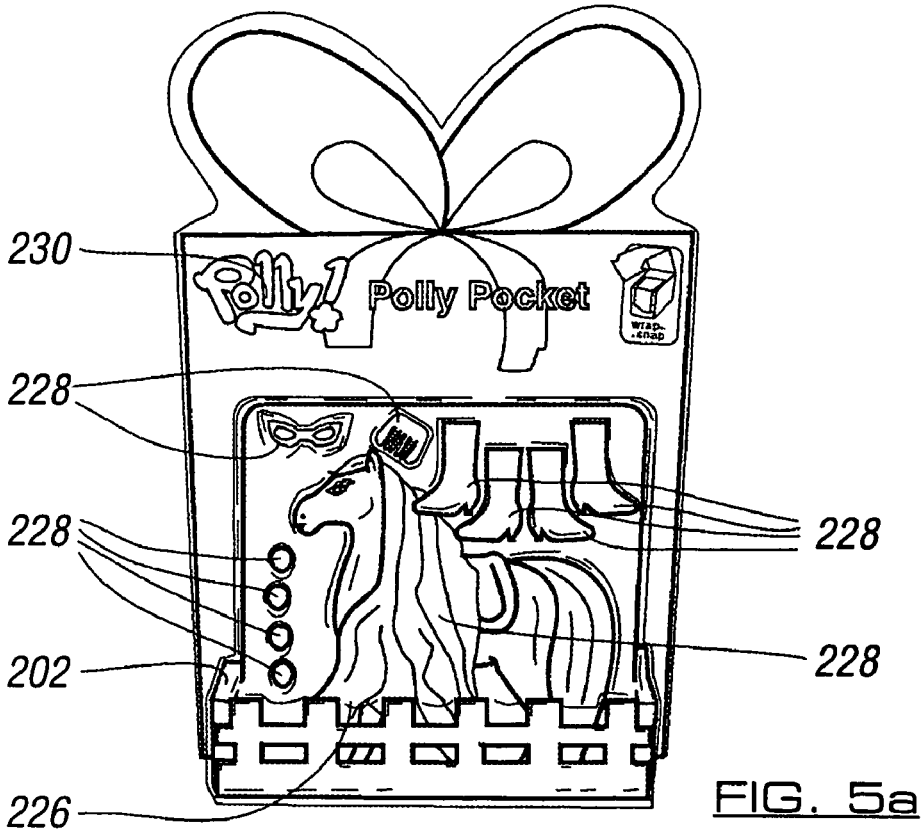

Specific embodiments of the invention are now described with reference to the accompanying drawings, wherein:

FIGS. 1*a-d* illustrate a first embodiment of the invention;

FIGS. 2*a-d* illustrate a second embodiment of the invention;

FIGS. 3*a-e* illustrate movement of the package in accordance with one embodiment of the invention between said first and second conditions;

FIGS. 4*a* and *b* illustrate a further embodiment of a package in accordance with the invention; and FIGS. 5*a* and *b* illustrate a yet further embodiment of a package in accordance with the invention.

Referring firstly to FIGS. 1*a-d,* there is illustrated a package 2 which comprises a top wall 4, a bottom wall 6, a front wall 8, a rear wall 10 and first and second end walls 12, 14. Also provided as part of the package is a flap 16 which is foldably connected, in this case to side wall 8 via fold line 18, and has a further fold line 20. The flap also includes a locking portion 22 which is provided for selective engagement with an engagement means 24 formed on the package.

FIGS. 1*a-d* illustrate various forms which can be used in conjunction with the invention with FIG. 1*a* illustrating the flap 16 in an intermediate position with respect to the remainder of the package 2 for purposes of illustration. The side walls 4 and 8 include a display portion 26 which is effectively an aperture formed in the card material which is used to form the package and said aperture is provided with a clear plastics material so as to allow an item or items within the package to be viewable from externally of the package. This arrangement is typically provided for retail purposes and at which point the package is provided in the first condition as illustrated with respect to FIG. 1*d* where the display portion 26 is viewable and the flap 16 is moved to a position with a first portion 16' lying adjacent to the bottom wall 6 and the second part of the flap 16" lying adjacent to and in line with the rear wall 10 so that the same faces away from the purchaser when the package is on display with the display portion 26 viewable and facing the potential purchaser.

Figure 1B:
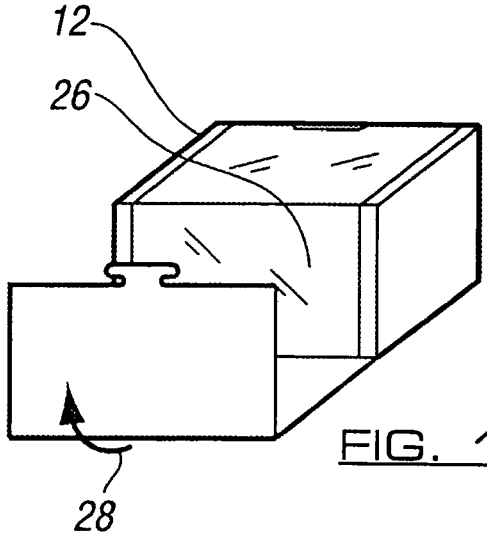
Figure 1C:
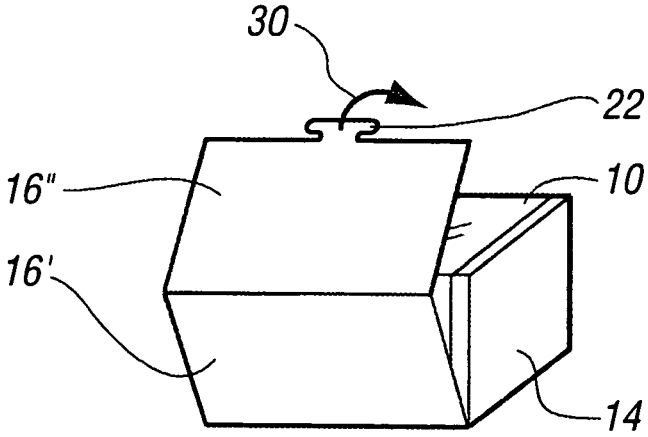
Figure 1D:
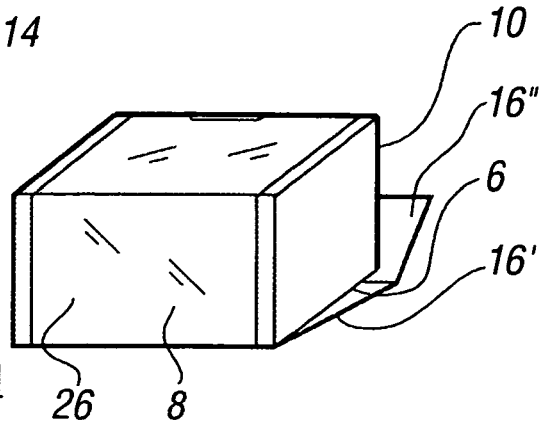

Once purchased, and in accordance with the invention, if the purchaser wishes to present the product as a gift, the flap 16 can be moved from the position shown in FIG. 1*d* and, as indicated by the arrow 28, folded upwardly as shown in FIG. 1*b* to a position over the display portion 26 to mask the same. The flap is also moved in the direction indicated by arrow 30 in FIG. 1*c* such that the flap locking portion 22 can be engaged with the engagement means 24 which, in this example, is an aperture formed in the package side wall 10. In this position, the display portion 26 is entirely masked and therefore the person to whom the package is given will have no idea as to the contents of the same as they are not able to view the item or any printed information relating thereto.

An example of practical implementation of the invention is shown in FIGS. 2*a-d* where the same reference numerals are used for ease of illustration as were used in FIGS. 1*a* to *d.*

Figure 2A:
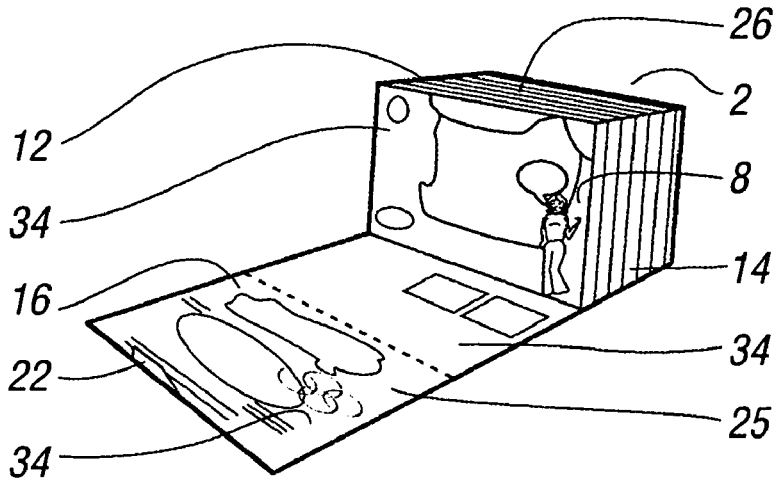
Figure 2B:
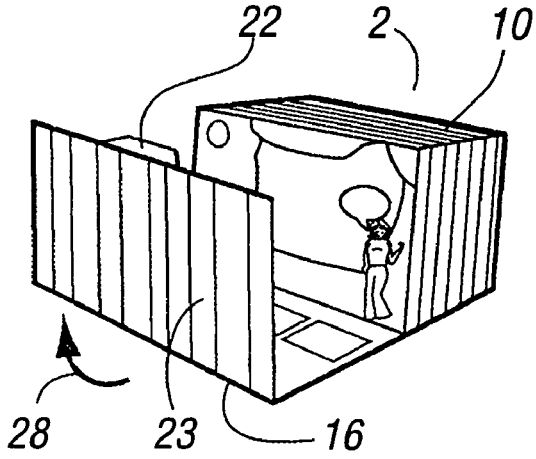
Figure 2C:
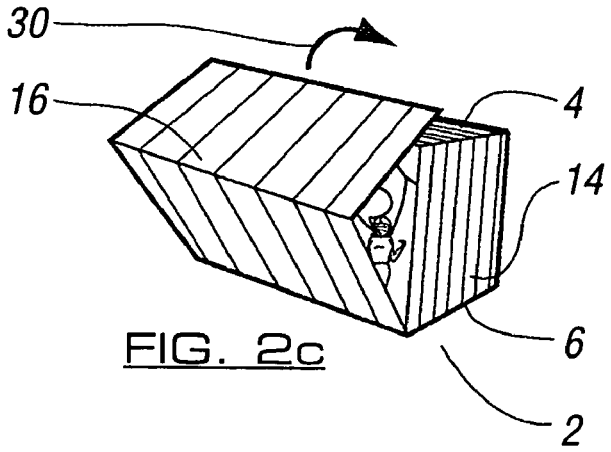
Figure 2D:
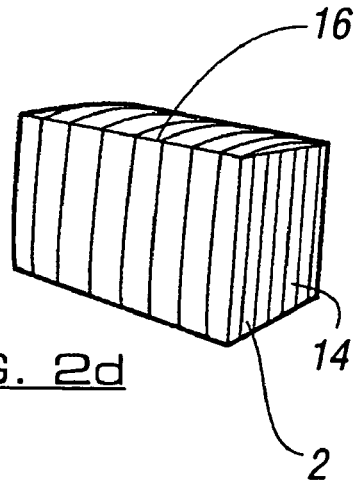
Figure 3A:
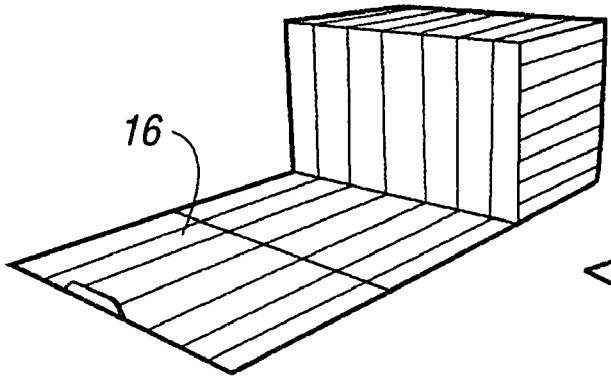
Figure 3B:
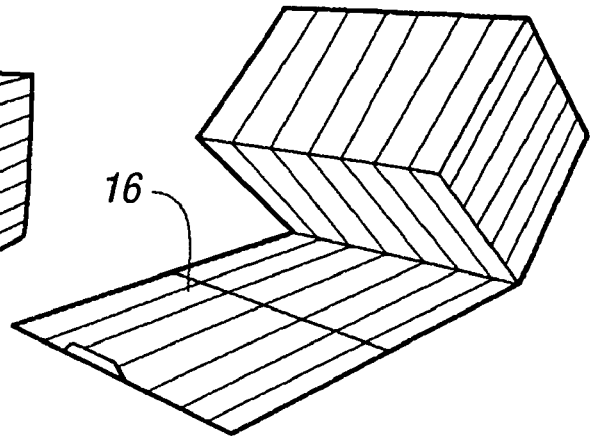
Figure 3C:
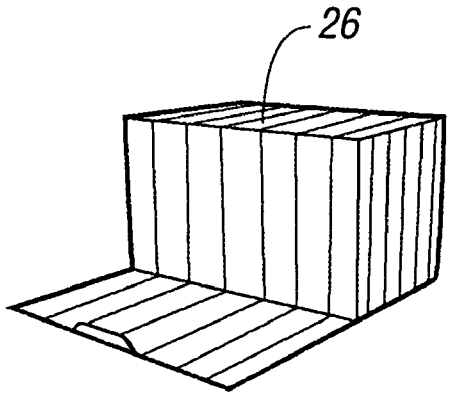
Figure 3D:
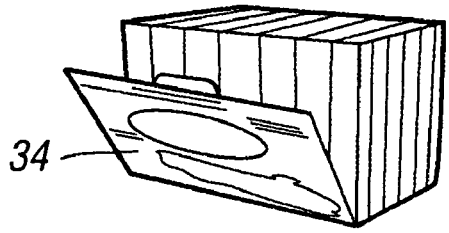
Figure 3E:
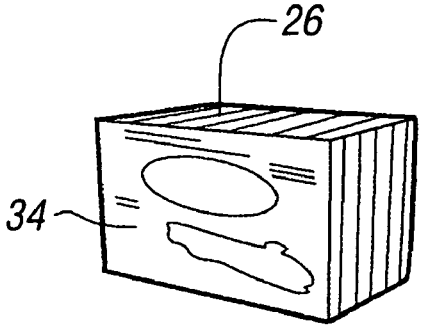

FIGS. 2*a-d* illustrate the movement of the flap 16 from a position following purchase of the package, to a second condition in which the package is in a gift form as shown in FIG. 2*d*. Also shown in FIGS. 2*a-d* is the manner in which a pattern can be used to improve the appearance of the gift box. The surfaces of the walls which do not include the display portion for the item formed thereon, namely the outer surfaces of the walls 10, 12, 14 and 6 have a pattern formed thereon, typically by printing, which in this case, is in the form a series of stripes of different colours. Equally, one surface 23 of the flap 16 has the same striped pattern applied thereto such that when the flap 16 is moved to the position shown in FIG. 2*d* all of the outer faces of all of the walls of the package when in the second condition, have the same external pattern, and therefore form an attractive gift package.

While the provision of this pattern is of great advantage when providing the gift, there are different requirements when the package is in the first condition and is to be used for retail purposes as, at these times, the item within the package are viewable through display portion 26 and/or information relating to the item is required to be viewable as well as other information such as the address of the manufacturer, bar codes and the like so that the package has to be usable in a normal retail function. To this end, as shown in FIG. 2*a* the faces of the walls 12 and 8 which include the display portion 26 and also the surface 25 of the flap 16 are provided with printed material which relates to the items within the package and which form the typical appearance of the retail package. The relevant printing on the surface 25 of the flap 16 is given by the reference numeral 34 and it is these printed faces which will be viewable when the package is in a retail function.

FIGS. 3*a* to *e* illustrate how the package can be moved into the first condition for the retail function by the folding of the flap 16 around the remainder of the package such that the printed surfaces 34 of the flap 16 form the outer walls of at least some of the walls of the package and at the same time leave the display portion 26 open such that items within the package can be viewed.

Figure 4B:
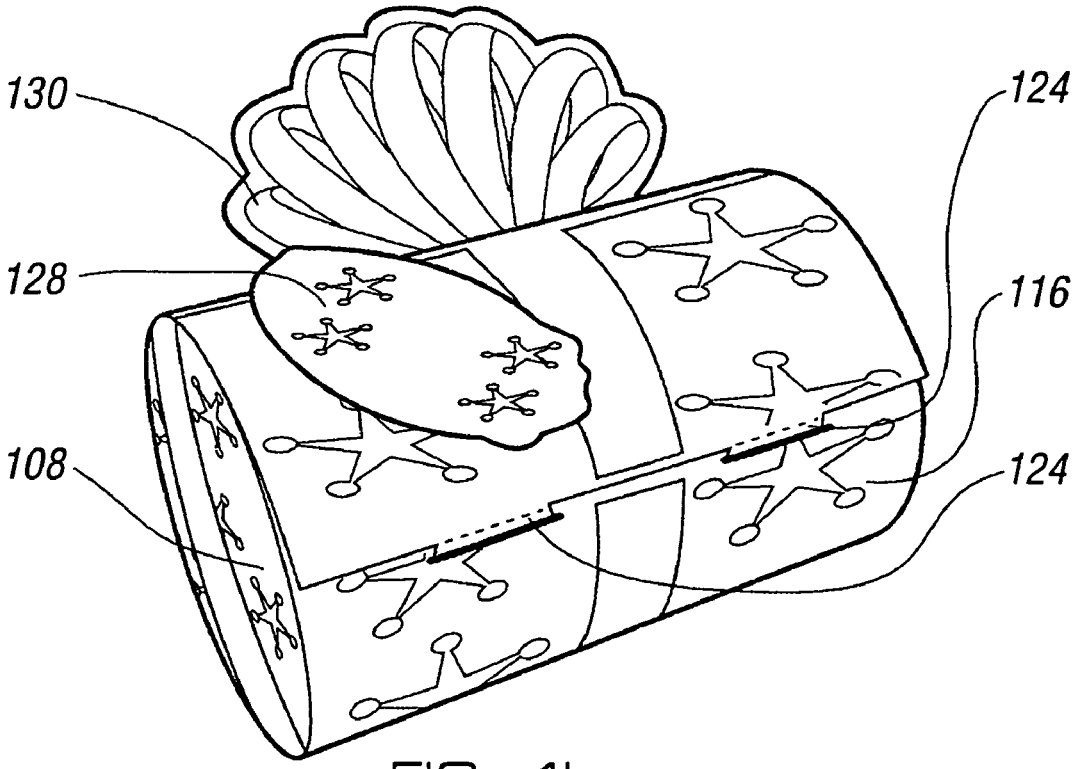

FIGS. 4*a-b* and FIGS. 5*a-b* illustrate further embodiments of the package in accordance with the invention. FIGS. 4*a* and *b* illustrate a cylindrical package 102 which is provided with a display portion 126 in the form of an aperture 104 and printed material 106 relating to the item (not shown) to be contained within the package. FIG. 4*a* illustrates the package in a first condition and it will be seen how the top face 108 has a printed pattern on the external surface and also a piece of ribbon 110 attached to or depicted thereon. Also partially shown is the flap 116 with locking portions 124 and the flap and package in FIG. 4*a* are in the first condition for retail purposes. FIG. 4*b* shows the package of FIG. 4*a* in a second condition in which the flap 116 has been moved to a new position in which the same overlies the display portion 126 and masks the same from view. The locking means 124 retain the flap 116 and hence the package in the second condition. It is also illustrated how the pattern printed on the externally viewable surface of the flap 116 matches that of the top face thereby enhancing the visual appearance of the package. Furthermore it is illustrated how further accessories can be provided and affixed to the package in the second condition so as to be viewable, such as a gift card 128 and portion 130.

Figure 5B:
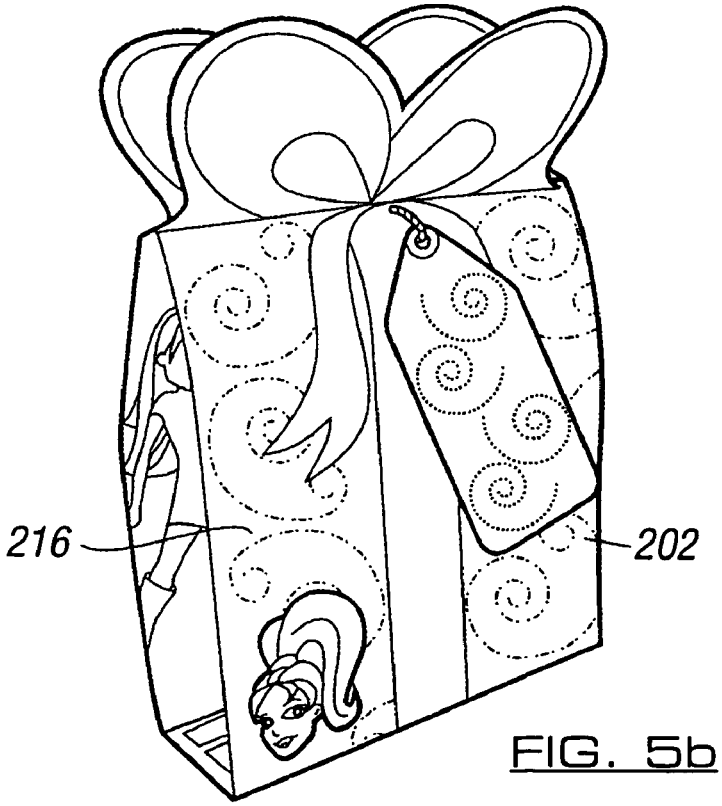

FIGS. 5*a* and *b* illustrate a further form of packaging 202. In this case in the first condition as illustrated in FIG. 5*a,* the display portion 226 includes an aperture through which the items 228 within the package are viewable in addition to the printed information 230 relating thereto. In FIG. 5*b* the display portion and items and printed information have been masked by the folding of the flap 216 over the same to mask them and hence form the package into the second condition.

It will therefore be appreciated that the present invention provides a package which can be used for retail purposes so as to display the items within the package for sale and therefore provide optimum display of the same and, at the same time, can then be adapted, following purchase, into a gift package form thereby allowing the same to be given a gift without the need for additional wrapping paper to be used.

As part of the invention there is provided a blank for forming the package, said blank including portions foldably connected to form external walls of the package. The blank is typically of card material with fold lines defining edges of external walls of the package and allowing the package to be formed from a single blank. The blank is shaped and formed to allow the embodiments shown in the Figures to be achieved. Normally the blank is erected to the first, retail condition in which at least one of the external walls is viewable and the item or items can be placed therein. The flap or further portion of the blank is held in a first location when first erected and is subsequently movable to the second condition by the purchaser of the package by movement of the said further portion of the blank to a second location at which the said at least one external wall is masked by the said further portion.

While the invention is deemed to be of particular advantage for packaging for toys, it will readily be appreciated that the packaging as herein described, can be used for any form of item.

The invention claimed is:

1. A package containing at least one item therein, said package including external walls and provided for use in a first condition as a retail pack in which the item and/or information relating to the item is viewable from external of the package and in a second condition in which the item and any information relating to the item is masked by a portion of the package which is movable to change the package between said first and second conditions; wherein said item is located and retained within the package in both conditions and said condition changes occur prior to the removal of the item from the package; and wherein:

said external walls include a top wall, a front wall, a bottom wall, a rear wall and a pair of side walls connected together to form the package, said top wall and said front wall each include an aperture having clear plastic material allowing viewing therethrough, said external walls further include a first locking portion, said package includes a flap joined thereto with said flap having a proximal end connected to said front wall and a distal end with a second locking portion formed thereon, said flap further having a first crease line and a second crease line extending thereacross with said first crease line located at said proximal end and said second crease line located between said proximal end and said distal end dividing said flap into a first cover and a second cover sized to mask said top wall and said front wall when said flap is folded in a first direction along said first crease line and said second crease line and locking said first locking portion and said second locking portion together positioning said first cover outwardly adjacent said top wall and said second cover outwardly adjacent said front wall concealing an item within said package, said flap foldable in a direction opposite to said first direction positioning said first cover and said second cover adjacent said rear wall and said bottom wall allowing viewing through said plastic material of said front wall and said top wall of an item within the package.

2. A package according to claim 1 wherein said flap selectively movably with respect to the package to allow the condition of the package to be changed.

3. A package according to claim 2 wherein the flap is movable to a position overlying at least part of the remainder of the package.

4. A package according to claim 2 wherein the flap is movable from a first position in which the package is in said first condition to a second position in which the package is defined as being in said second condition.

5. A package according to claim 4 wherein the flap is movable about at least one fold line formed on the package so as to allow the same to be moved between the first and second conditions.

6. A package according to claim 2 wherein the flap includes a locking portion for selective engagement with matching engagement means provided on the package so as to allow the flap to be retained with the package in the first and/or second conditions.

7. A package according to claim 1 wherein the item is viewable with the package in the first condition through an aperture which acts as a display portion of the package.

8. A package according to claim 7 wherein a flap portion is of a size and provided with fold lines so as to be positionable, when the package is in the second condition, to mask said display portion.

9. A package according to claim 1 wherein the package includes printed information relating to the at least one item which is within the package and which information is viewable with the package in the first condition and a flap portion is of a size and is positionable such that, when the package is moved to the second condition, the printed information is hidden from view.

10. A package according to claim 1 wherein those walls of the package which are not masked in the second condition are provided with an outer surface with a pattern printed thereon.

11. A package according to claim 10 wherein a flap is provided which is movable to change the package between first and second conditions and said flap is provided with a printed pattern on a surface thereof such that when the flap portion is moved to bring the package to a second condition, the said surface forms an outer surface of the package and the pattern applied thereto is viewable.

12. A package according to claim 11 wherein the pattern applied to the walls of the package and the pattern applied to the surface of the flap match, such that when the package is in the second condition, the outer surface of the package, as a whole, has a matching pattern.

13. A package according to claim 11 wherein the flap has printed material applied on the opposing surface to the said pattern, said printed material viewable when the package is in the first condition.

14. A package according to claim 1 wherein the package in the second condition, has the appearance of a gift and the item within the package is not viewable.

15. A package according to claim 1 wherein the wall(s) of the package include a display portion and a printed display applied thereto and the purpose of that is to make the package as attractive as possible when in the first condition to a potential purchaser when the package is used at a retail point.

16. A package according to claim 1 wherein the at least one item in the package is a toy and there is included a sample means which, when pressed or otherwise activated by a person, allows an action or effect of the toy to be generated, said sample means only exposed for use when the package is in the first condition.

17. A package according to claim 1 wherein the package is formed from card material.

18. A package according to claim 12 wherein the package includes a viewing aperture, said aperture is covered by clear plastic material.

19. A package according to claim 1 wherein the package includes a flap which is movable from a position in which the same forms at least one double wall of the package when in the first condition, to a position to form another double wall of the package in the second condition and mask an item and/or information from view externally of the package.

20. A blank for forming a package for holding an item therein, said blank including portions foldably connected to form external walls of the package, said blank being erectable to a first condition in which at least one of the external walls, displaying information relating to the item, is viewable with a further portion of the blank held in a first location, and said blank is movable to a second condition by movement of the said further portion of the blank to a second location at which the said portion at least one external wall is masked by the said further portion, thereby hiding from view the item and all information relating to the item; wherein the item is located and retained within the package in both first and second conditions and the change in condition is performed prior to removing the item from the package; and wherein:

said external walls include a top wall, a front wall, a bottom wall, a rear wall and a pair of side walls connected together to form the package, said top wall and said front wall each include an aperture having clear plastic material allowing viewing therethrough, said external walls further include a first locking portion, said package includes a flap joined thereto with said flap having a proximal end connected to said front wall and a distal end with a second locking portion formed thereon, said flap further having a first crease line and a second crease line extending thereacross with said first crease line located at said proximal end and said second crease line located between said proximal end and said distal end dividing said flap into a first cover and a second cover sized to mask said top wall and said front wall when said flap is folded in a first direction along said first crease line and said second crease line and locking said first locking portion and said second locking portion together positioning said first cover outwardly adjacent said top wall and said second cover outwardly adjacent said front wall concealing an item within said package. said flap foldable in a direction opposite to said first direction positioning said first cover and said second cover adjacent said rear wall and said bottom wall allowing viewing through said plastic material of said front wall and said top wall of an item within the package.

21. A method of forming a gift from a retail package, said method comprising the steps of purchasing an item held within a package in a first retail display condition in which the item and/or information relating to the item is viewable on and/or via at least one face external of the package and wherein the package is manipulable without removing the item from the package, into a second condition in which the item and any printed information relating thereto is masked from external view, wherein the item is located within the package and protected from access in both conditions of the package and the change in condition is performed prior to removing the item from the package; and wherein:

said package having external walls that include a top wall, a front wall, a bottom wall, a rear wall and a pair of side walls connected together to form the package, said top wall and said front wall each include an aperture having clear plastic material allowing viewing therethrouah, said external walls further include a first locking portion, said package includes a flap joined thereto with said flag having a proximal end connected to said front wall and a distal end with a second locking portion formed thereon, said flap further having a first crease line and a second crease line extending thereacross with said first crease line located at said proximal end and said second crease line located between said proximal end and said distal end dividing said flap into a first cover and a second cover sized to mask said top wall and said front wall; and comprising the additional steps of:

folding said flag in a first direction along said flap in a first direction along said first crease line and said second crease line;

locking said first locking portion and said second locking portion together including the sub-step of positioning said first cover outwardly adjacent said top wall and said second cover outwardly adjacent said front wall concealing an item within said package, and, folding said flap in a direction opposite to said first direction including the sub-step of positioning said first cover and said second cover adjacent said rear wall and said bottom wall allowing viewing through said plastic material of said front wall and said top wall of an item within the package.

22. A method according to claim 21 wherein the manipulation includes moving a part of the package from a first position to a second position.

23. The package of claim 1 wherein:

said package has an external size which is constant both in said first condition and in said second condition.

* * * * *

UNITED STATES PATENT AND TRADEMARK OFFICE

CERTIFICATE OF CORRECTION

PATENT NO. : 7,578,393 B2
APPLICATION NO. : 11/108180
DATED : August 25, 2009
INVENTOR(S) : Kevin Gillon It is certified that error appears in the above-identified patent and that said Letters Patent is hereby corrected as shown below:

In column 8, line 19, please change "therethrouah" to --therethrough--.

In column 8, line 21, please change "flag" to --flap--.

Signed and Sealed this

Sixth Day of July, 2010

David J. Kappos

David J. Kappos
*Director of the United States Patent and Trademark Office*